United States Patent [19]

Mattson

[11] 4,109,975

[45] Aug. 29, 1978

[54] METHOD OF BEARING A PIVOTING MEMBER INTENDED TO TRANSMIT GREAT FORCES AND A BEARING OF SUCH A PIVOTING MEMBER

[75] Inventor: Arne J. Mattson, Vasteras, Sweden

[73] Assignee: Paul Anderson Industrier AB, Vasteras, Sweden

[21] Appl. No.: 727,567

[22] Filed: Sep. 28, 1976

[30] Foreign Application Priority Data

Oct. 7, 1975 [SE] Sweden ..... 7511230

[51] Int. Cl.[2] ..... B66F 1/06; F16C 11/02

[52] U.S. Cl. ..... 308/26; 254/108; 308/238

[58] Field of Search ..... 308/28, 184 R, 238, 308/26, 37, 2; 254/108; 248/8

[56] References Cited

U.S. PATENT DOCUMENTS

| | | | |
|---|---|---|---|
| 3,309,153 | 3/1967 | Kelley et al. | 308/238 X |
| 3,989,126 | 11/1976 | Katzer | 308/28 X |

FOREIGN PATENT DOCUMENTS

| | | | |
|---|---|---|---|
| 242,233 | 1/1964 | Netherlands | 254/108 |
| 1,385,884 | 3/1975 | United Kingdom | 254/108 |

*Primary Examiner*—Stephen G. Kunin
*Assistant Examiner*—Douglas C. Butler
*Attorney, Agent, or Firm*—Sughrue, Rothwell, Mion, Zinn and Macpeak

[57] ABSTRACT

A method of bearing a pivoting member on an axle which member is intended to transmit great forces between two other members. The pivoting member may constitute a load transmitting latch pivotable between an operative and inoperative position. The latch is mounted such that there is only a small clearance between a rear surface thereof and a complenetary surface of the associated holding member. The mounting permits shifting of the latch relative to its associated holding member such that the latch in the operative load carrying position is displaced in the longitudinal direction thereof through such a distance that the load transmitting direct contact engagement is obtained between the surfaces.

14 Claims, 3 Drawing Figures

METHOD OF BEARING A PIVOTING MEMBER INTENDED TO TRANSMIT GREAT FORCES AND A BEARING OF SUCH A PIVOTING MEMBER

This invention relates to a method of bearing a pivoting member, on an axle which member is intended to transmit great forces between two means, such as a load transmitting latch pivotal between an operative and an inoperative position. The invention also relates to a bearing of such a pivoting member.

It is known to lift or lower heavy loads by utilizing so-called climbing jacks, i.e. jacks movable by steps upwards or downwards along an associated rod. The jack alternatively may be arranged fixed, and the rod be lifted or lowered by the jack. Jacks of this kind usually comprise an upper yoke and a lower yoke removable from and approachable to each other, respectively, by means of hydraulic cylinders provided between the yokes, but also by using screws or other means. By positioning the yokes about a rod, so-called climb rod, and providing them with locking members to temporarily lock the yokes to the rod, such an arrangement can be caused to climb along the rod by alternatingly locking the upper yoke and the lower yoke to the rod. The yoke being locked temporarily to the rod receives in this position the entire load, which thereby is transmitted to the climb rod. The locking members to be utilized for this locking, consequently, must meet high requirements, and they usually are designed either as clamping jaws disposed on said yokes and acting symmetrically on the rod, or as latches mounted pivotally in the yokes and co-operating with shoulders on the climb rod. By arranging the latches in pairs directly in front of each other, a balancing of arising horizontal forces is obtained.

Locking members in the form of clamping jaws cannot be applied to the large-size jacks since recently demanded for handling loads exceeding 100 tons, nor can the latches supported on an axle a present in use be utilized in connection with jacks of said size, because the entire load to be carried by the jack then must be transmitted from the yokes via the latches and their axles to the climb rod. This would require such an extension of the bearing for the axle, in order to prevent the load per surface unit in the bearing from exceeding a predetermined permissible upper limit, and such a dimension of the axle, that the entire arrangement would assume dimensions which are entirely unrealistic.

One main object of the present invention is to provide a method of bearing a pivoting member on an axle so that the member can transmit very great forces without requiring the axle be dimensioned correspondingly. Another object is to provide a simple bearing of such a member.

These objects are achieved according to the invention by arranging said members, so that upon their loading a load-transmitting engagement is obtained between an outer surface of the member and a complementary surface of a co-operative means. The forces, thus, instead of via the axle of rotation of the member are transmitted directly between said surfaces, which surfaces are stationary relative to each other during the period of load engagement.

When applying the invention to climbing jacks with latches, the latches are mounted so that there is only a small clearance between a rear cylindric surface of the latches and a complementary surface of the corresponding yoke, and so that the latches upon load engagement with the climb rod are so displaced as to establish load transmitting engagement also between said surfaces.

One way of achieving this is to design the axle so weak and to arrange it so that upon loading of the latch the axle resiliently yields through a distance sufficient to bring about said load transmitting engagement. The latch, alternatively, may be provided with a through bore for the axle, which bore has a greater diameter than the axle, and/or the axle be supported in oversized bores in associated holders.

In order to obtain, in spite thereof, a satisfactory guiding of the latches, preferably an elastic bushing is provided about the axle in said bores. When the latch is being subjected to load, the elastic bushing is compressed until load transmitting contact is established between the surface of the latch and the complementary surface in the yoke. The axle, therefore, need take up only the force required for the compressing of the elastic bushing. In order to facilitate the rotation of the latch, said bushing preferably is enclosed by a sleeve of anti-friction metal.

Further characterizing features of the invention become apparent from the claims.

The invention is described in greater detail in the following, with reference to the embodiments shown by way of example in the accompanying drawings, in which FIG. 1 is a schematic lateral view of a climbing jack according to the invention.

Figure 1:
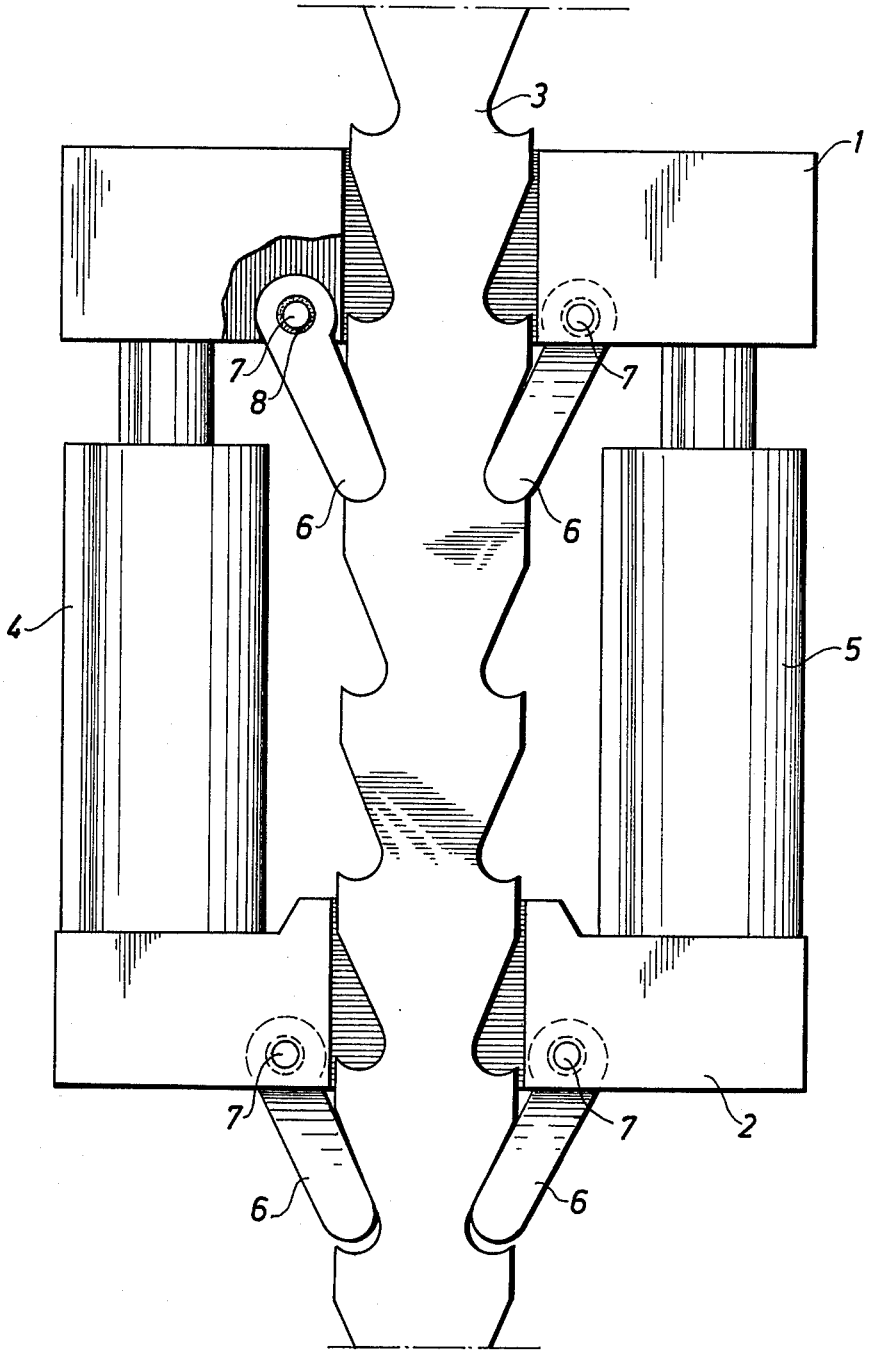

The climbing jack according to FIG. 1 comprises an upper yoke 1 and a lower yoke 2, which surround a climb rod 3 on three sides, i.e. the yokes 1 and 2 in a horizontal view are substantially U-shaped. Said yokes can be displaced from and approached to each other, respectively, by means of hydraulic cylinders 4 and 5, respectively. In order to render possible climbing upwards and downwards, respectively, along the rod 3, each yoke is provided with two opposed latches 6 co-operating with corresponding shoulders on the climb rod. As the latches are arranged in pairs, no horizontal net forces act upon the jack. Each latch 6 is pivotable about an associated axle 7 by associated means (not shown).

In order to prevent said axle 7 from being exposed to the great forces to be transmitted between the yokes and the climb rod, via said latches the axle is provided in a bore in the associated latch 6 which bore has a slightly greater diameter than the axle. The latch further is so disposed in the associated yoke that there is a clearance between the rear cylindrical surface of the latch and a complementary surface of the yoke. Said clearence is smaller than the difference in diameter between said axle and associated bore. This implies that the latch when being subjected to load is displaced slightly relative to the axle 7 in the longitudinal direction of the latch until the rear cylindrical surface of the latch engages the complementary surface of the yoke. The entire load carried by the jack thereby is transmitted directly to the climb rod via the material of the latch, without affecting the axle and its bearing.

Figure 2:
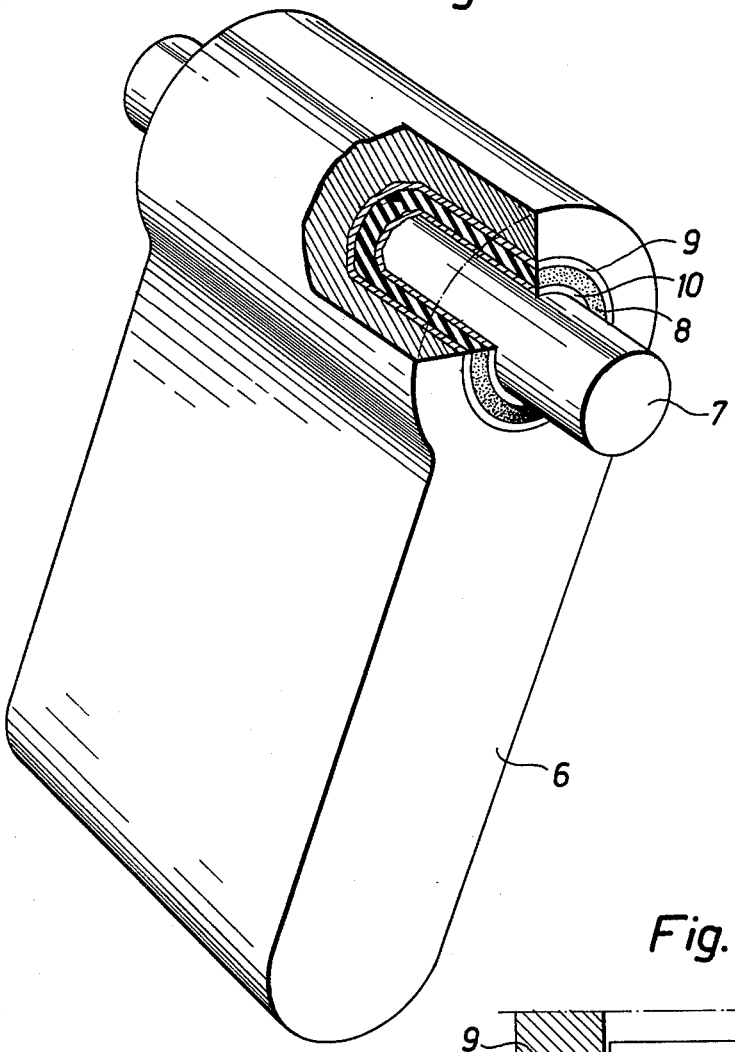
FIG. 2 shows a latch of the type used in the jack according to FIG. 1.

As is more clearly apparent form FIG. 2, an elastic cylindrical bushing 8 is placed about the axle 7 in said bore in the latch 6 to provide a good guiding in spite of the oversized bore. In order to facilitate rotation of the latch, said bushing 8 which, for example, may consist of a suitable rubber material, is disposed between an outer sleeve 9 and an inner sleeve 10 of anti-friction material. The only force to be taken up by the axle 7 in connection with the transmission of great forces between the associated yoke and the climb rod via the latch, thus, is the force reguired for compressing the elastic bushing 8 to a degree sufficient to establish load transmitting engagement between the cylindrical rear surface of the latch and the corresponding surface of the yoke. The axle 7, therefore, can be relatively weak even in devices intended for very heavy loads.

Figure 3:
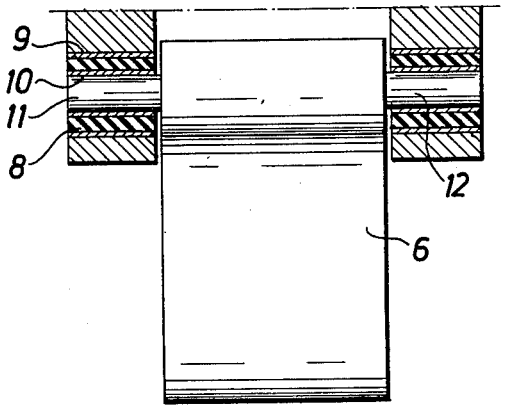
FIG. 3 illustrates in a schematic manner an alternative bearing of said latch.

In FIG. 3 another embodiment of the bearing of the latch 6 is shown, in which the latch is provided with fixed axle journals 11 and 12, respectively. In order to achieve the same effect as in connection with the latch according to FIG. 2, said axle journals are arranged in bores in an associated holder, which bores have a great diameter than said journals. The holders can be formed in the yokes or be composed of separate external members. Also in this case preferably an annular bushing of the same kind as described with reference to FIG. 2 is placed about each axle journal. Futher, the embodiments according to FIGS. 2 or 3 can also be combined.

In order to reduce among other things the risks of fatigue phenomena in the material of the elastic bushings, the bushings preferably can be divided into several rings spaced relative to each other. This permits the material upon its compression to expand slightly in lateral direction.

The same effect as above can be obtained also by designing the axle 7 with relatively small dimensions and in such a manner, that it resiliently can yield through a distance sufficient to establish the load transferring contact between the latch and the seat in the yoke. The axle must be mounted so as to have a certain free resilient length, in order to avoid too great shearing forces. This can be achieved for instance by positioning the axle in a bore in the latch, which bore is wider at its ends and having, for instance, conical form.

The invention can also be varied in other respects within the scope of the claims. The elastic bushings, for example, can be omitted, so that between the axle and the associated bearing bore a clearance is formed which is greater than the distance between the rear surface of the latch and the corresponding surface in the associated yoke. The invention, besides in connection with jacks moving along a climb rod arranged at a desired angle, can be applied also, for example, in connection with stationary jacks displacing a rod in one direction or the other.

What is claimed is:

1. A method of pivotably bearing a first member on a second member by means of an axle, said first member intended to transmit great forces between said second member and a third member, and wherein said first member may constitute a load transmitting latch pivotal between an operative and an inoperative position, said method comprising the steps of:

providing opposed complementary surfaces on said first and second members which face each other but have only a small clearance therebetween when said first member is in an operative position with respect to said third member, and pivoting said first member on said second member by an axle bearing which permits displacement of said first member with respect to said second member upon load engagement in operative position such that a load transmitting engagement is obtained between said complementary surfaces.

2. A method according to claim 1, wherein the step of pivotably mounting said first member on said second member comprises resiliently mounting said axle so that upon loading of said first member relative to said second member, said axle yields a distance sufficient to establish said load transmitting engagement between said surfaces.

3. A method according to claim 1, wherein said step of pivotably mounting said first member with respect to said second member comprises the step of providing said second member with a through bore for said axle which has a diameter in excess of that of said axle.

4. A method according to claim 3, wherein said step of pivotably mounting said first member on said second member further comprises providing an elastic bushing carried by said bore and between said bore and said axle.

5. A method according to claim 1, wherein said step of pivotably mounting said first member on said second member comprises the step of providing holders on opposite sides of said first member, providing an axle on said first member which extends to each side thereof and receivable within respective of said holders with the diameter of said bores exceeding that of said axle.

6. The method according to claim 5, wherein said step of pivotably mounting said first member to said second member further comprises providng an elastic bushing about said axle within each of said bores.

7. In a load transmitting assembly including a first member pivotably mounted on an axle to a second member with said first member pivotable between an operative and an inoperative position, and wherein in the operative position said first member transmits great forces between said second member and a third member, the improvement wherein: said first member has a surface portion which when in the operative position is spaced from a complementary surface of said second member through a small clearance and means for mounting said first member through said axle on said second member such that upon load engagement with said first member in said operative position said first member is displaceable through a distance to effect load transmitting engagement between said complementary surfaces.

8. The assembly according to claim 7, wherein said axle is resiliently mounted with respect to said second member such that upon loading of said second member said axle yields a distance sufficient to establish load transmitting engagement between said surfaces of said first and second members.

9. The assembly according to claim 7, wherein said second member is provided with a bore, said first member carries said axle with said axle positioned within said bore, and wherein said bore has a diameter in excess of that of said axle.

10. The assembly according to claim 9, wherein said bore carries an elastic bushing which surrounds said axle.

11. The assembly according to claim 10, wherein said elastic bushing comprises a sleeve of elastic material, and said sleeve is enclosed between two sleeves of harder material having good slide bearing properties and bearing on said axle and said bore respectively.

12. The assembly according to claim 10, wherein said bushing comprises several spaced bushing rings.

13. The assembly according to claim 7, wherein said axle extends to each side of said first member, and wherein associated holders are provided to each side of said first member and constitute portions of said second member and are provided with bores receiving said axle with said bores having a diameter in excess of that of said axle.

14. The assembly according to claim 13, wherein said second member comprises two opposed axle journals which project from said member and define the pivot axis for said axle.

* * * * *